US010842208B2

(12) United States Patent
Ahmed

(10) Patent No.: US 10,842,208 B2
(45) Date of Patent: Nov. 24, 2020

(54) GLOVE WITH A FINGER BASED FOURCHETTE STRUCTURE

(71) Applicant: Mohammed Ejaz Ahmed, Glenmont, NY (US)

(72) Inventor: Mohammed Ejaz Ahmed, Glenmont, NY (US)

( * ) Notice: Subject to any disclaimer, the term of this patent is extended or adjusted under 35 U.S.C. 154(b) by 0 days.

(21) Appl. No.: 16/382,355

(22) Filed: Apr. 12, 2019

(65) Prior Publication Data

US 2019/0231009 A1 Aug. 1, 2019

Related U.S. Application Data

(63) Continuation-in-part of application No. 15/622,414, filed on Jun. 14, 2017, now Pat. No. 10,258,095.

(51) Int. Cl.
*A41D 19/02* (2006.01)

(52) U.S. Cl.
CPC ..... *A41D 19/02* (2013.01); *A41D 2300/50* (2013.01)

(58) Field of Classification Search
CPC . A41D 9/02; A41D 9/006; A41D 9/00; A41D 9/015; A41D 9/01529
See application file for complete search history.

(56) References Cited

U.S. PATENT DOCUMENTS 1,542,199 A * 6/1925 White ..... A41D 19/02 2/161.6
1,620,643 A * 3/1927 Herman ..... A41D 19/02 2/161.6
1,666,023 A * 4/1928 Sturm ..... A41D 19/02 2/169
2,538,837 A * 1/1951 Johnston ..... A41D 19/02 2/169
2,728,082 A * 12/1955 Slimovitz ..... A41D 19/02 2/167
4,590,626 A 5/1986 Chen
4,987,614 A 1/1991 Murray
5,167,038 A * 12/1992 Rinehart ..... A41D 19/0006 2/163
5,504,942 A * 4/1996 Kuwahara ..... A41D 19/02 2/163
5,603,119 A * 2/1997 Rinehart ..... A41D 19/02 2/169
5,924,137 A 7/1999 Gold
6,029,276 A * 2/2000 White ..... A41D 19/01529 2/161.1
6,732,378 B2 5/2004 Novak
7,114,192 B1 * 10/2006 Prouty ..... A41D 19/015 2/161.6
7,536,730 B2 5/2009 Estrella
9,642,406 B2 * 5/2017 Kusjanovic ..... A41D 19/01547
2003/0106133 A1 6/2003 Novak
2007/0006362 A1 1/2007 Estrella
2008/0244808 A1 10/2008 Chaen
2009/0199319 A1 * 8/2009 Jenkin ..... A41D 19/0082 2/158
2010/0037362 A1 * 2/2010 Green ..... A41D 31/102 2/161.1

* cited by examiner

*Primary Examiner* — Gloria M Hale

(57) ABSTRACT

The fourchette structure in a glove is fabricated from the finger structure resulting in a glove having fewer seams, shorter seams and is more readily manufacturable using conventional materials. The resulting glove is more comfortable and is less prone to failure along its seams.

7 Claims, 9 Drawing Sheets

GLOVE WITH A FINGER BASED FOURCHETTE STRUCTURE

CROSS-REFERENCE TO RELATED APPLICATIONS

This application contains subject matter which is related to the subject matter of the following application, which is assigned to the same assignee as this application. The present application is a continuation-in-part of the application listed below which is hereby incorporated herein by reference in its entirety:

Comfortable Glove with Minimal Fourchette Structure, application Ser. No. 15/622,414, filed on Jun. 14, 2017 and now issued as U.S. Pat. No. 10,258,095 on Apr. 16, 2019.

TECHNICAL FIELD

The present invention is generally directed to gloves and their manufacture. More particularly, the present invention is directed to the manufacture of gloves with fourchette panels that are formed from finger portions. The fourchette panels extend upward along the fingers of the glove. However, the present invention is directed to the structure and manufacturing of a glove which is easier to manufacture and which also exhibits improved levels of comfort for the wearer and in which fourchette structures are formed from finger portions. Furthermore, in one particular embodiment of the present invention the finger portions are formed from a single (monolithic) piece of material.

BACKGROUND OF THE INVENTION

It is best to discuss the nature and background of the present invention by specifically describing for the reader exactly what a fourchette is. A fourchette is a portion of a glove. According to Wiktionary, a "fork-shaped instrument or device, specifically the forked structure between two fingers of a glove." Wikipedia refers to a fourchette as "the inside panels on the fingers of some glove styles." The Shorter Oxford English Dictionary (Sixth Edition; 2007) defines fourchette as a "forked object, instrument, or device; specifically the forked piece between two adjacent fingers of a glove." It is also useful to point out that a completed glove typically includes a palm portion (or palm side), finger extensions and a backside opposite to the palm portion.

However, there are certain problems with fourchette structures in gloves; they poses several problems and disadvantages. In particular, the addition of fourchettes in a certain glove structures and fabrication methods requires extra stitching thus making their manufacture more difficult, more costly and more time-consuming. Additionally, the presence of fourchettes in a glove structure provides an additional point of strain and produces an additional point of failure for the glove. In general, in any stitched fabric, the more seams there are, the greater is the opportunity to introduce a point of failure. Additionally, for some users, the inclusion of a fourchette produces a point of irritation.

It is noted that in certain glove manufacturing methods the back and palm portions have similar shapes with finger extensions being present on the palm structure as well as on the back portion. In such designs, the back and palm portions are stitched together along a single seem but if there is to be a fourchette structure additional steps and stitching are required even assuming that there is sufficient room for this stitching. However, in such a structure there is actually insufficient room for proper fourchettes. Accordingly, it is seen that fourchette structures provide both advantages and disadvantages.

From the above, it is therefore seen that there exists a need in the art to overcome the deficiencies and limitations described herein and above.

SUMMARY OF THE INVENTION

The shortcomings of the prior art are overcome and additional advantages are provided through the manufacture of a glove which has a plurality of fingers. The shortcomings of the prior art are overcome and additional advantages are provided through the manufacture of a glove which has a plurality of fingers. In the glove structure and manufacturing method of the present invention, the fingers of the glove are themselves employed to provide a fourchette structure. This saves in stitching costs and manufacturing time. The glove comprises: a palm portion, a thumb portion, a back portion having integral finger extensions and a plurality of separate individual finger extensions. The glove also includes stitching which joins together the back portion and the palm portion. There is also stitching which joins the separate finger extensions with the finger extensions present on the back portion of the glove. This stitching is provided in a manner in which fourchette structures are provided by the fingers themselves.

In one particular aspect of the present invention the separate individual finger extensions are fabricated from a single piece of material. In particular, in one embodiment of the present invention the pinky and ring fingers are fabricated from a single piece of material. In a similar embodiment of the present invention the middle and index fingers are fabricated from a single piece of material. While certainly not as desirable, it is also possible to fabricate the ring and middle fingers from a single piece of material.

The glove of the present invention comprises four different structures which are readily provided by stamping operations. These four kinds of structures are: a palm portion; a back portion having integral finger extensions; a separate set of individual finger extensions; and a thumb portion affixable to an opening in the palm portion. It is also noted that various ventilation features may be provided in different portions of the glove notably the back portion and the finger portions.

The present invention comprises a glove having a plurality of fingers and includes: a palm portion with attachment edges for attaching individual finger portions to the palm portion; the palm portion also has a thumb opening and there is a thumb portion affixed to the thumb opening in the palm portion; there is a back portion, having integral finger extensions with the back portion being sized to mate with the palm portion; there are a plurality of individual finger portions with tab extensions which attach to the palm portion along the attachment edges; stitching joins together the plurality of individual finger portions with the palm portion attachment edges; and stitching also joins together the finger extensions and the individual finger portions so as to form fingers for the glove. In this manner, the need to provide separate fourchette structures is eliminated.

Accordingly, it is an object of the present invention to provide a structure for a glove which is easily manufactured.

It is another object of the present invention to reduce the number of seams required in the manufacture of a glove.

It is yet another object of the present invention to reduce any irritation to a user that is introduced because of the presence of separately stitched-in fourchette structures along the fingers.

It is a still further object of the present invention to produce a glove which has fewer seams and therefore fewer potential points for failure.

It is still another object of the present invention to produce a glove which is easy to manufacture using a number of different materials including leather, suede, cotton, multiple fabrics and various elastomeric materials.

It is also an object of the present invention to provide a glove structure in which finger extensions are an integral part of the backside of the glove.

It is an additional object of the present invention to provide an easily manufacturable glove structure which also provides a means for ventilating perspiration that may develop with use.

Lastly, but not limited hereto, it is an even further object of the present invention to simplified glove manufacture.

Additional features and advantages are realized through the methods and techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
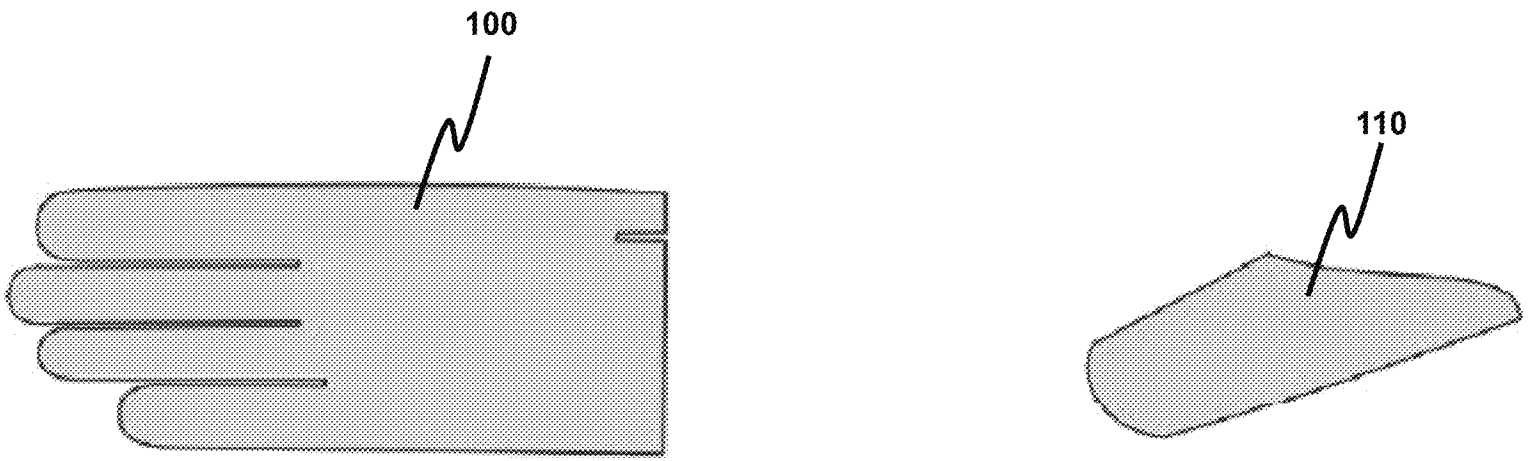
FIG. 1 is a top view illustrating the results of a stamping operation for producing the back of the glove and a thumb.
Figure 2:
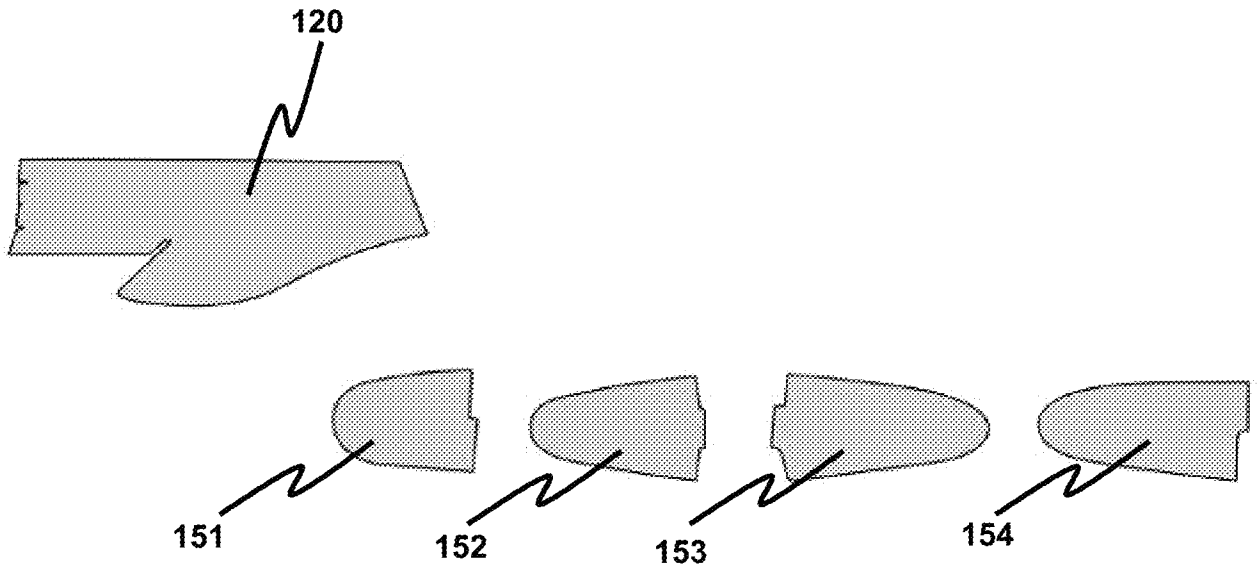
FIG. 2 is a top view illustrating the results of a stamping operation for producing the palm of the glove and four fingers.

FIG. 1 illustrates glove back 100 and thumb 110 used in the present invention. These parts are typically produced by a stamping operation as illustrated in the parent application. If necessary, they could also be produced by cutting operations. In a similar fashion FIG. 2 illustrates the results of a stamping operation used to produce palm portion 120 of the glove. Also illustrated in FIG. 2 is the presence of finger cut outs 151 (pinky), 152 (index finger), 153 (middle finger) and 154 (index finger). It is noted that while the present invention is described as producing a glove with five fingers (four fingers and a thumb), the invention is not limited to this number.

Figure 3:
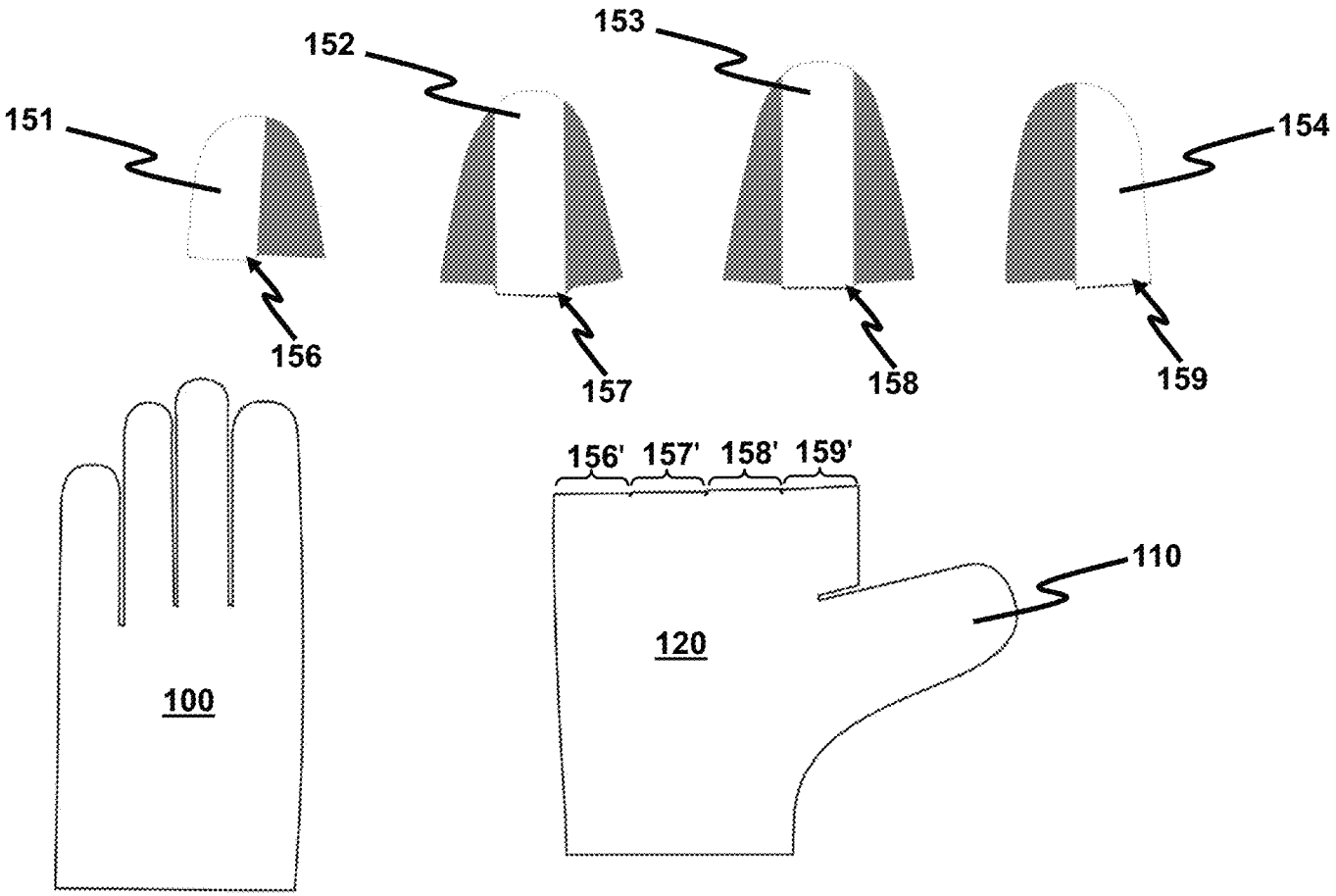
FIG. 3 is a top view illustrating the set of cutout materials that are employed in the manufacture of a glove in accordance with the present invention.

FIG. 3 provides a more detailed description of the finger pieces. In particular, it is seen that finger piece 151 also includes a slate extension or tab 156 which is employed for attachment to palm portion 120 of the glove. Note the connection between reference numeral 156 pointing to a finger portion and 156'. It is noted that palm portion 120 includes attachment points for the individual finger structures. Likewise, ring finger portion 152 with its tab extension 157 is ultimately affixed to palm portion 120 at location 157'.

It is noted that finger portions 151, 152, 153 and 154 are illustrated using shaded areas. These areas do not necessarily denote different materials or colors for the illustrated finger portions. Rather, the shaded portions in FIG. 3 illustrate those portions of the fingers that ultimately operate as providing the same function as a fourchette. While fourchettes typically occupy the spaces between the fingers that are closer to the palm, nonetheless in the present invention the structure of a fourchette is also fulfilled by the use of fingers installed in accordance with the present invention. Accordingly, FIG. 3 and other views herein illustrating shaded finger portions are not meant to convey the notion of different materials or structure but rather to illustrate that portion of the present invention which functions in a manner similar to a fourchette.

It is also worthy to note that FIG. 3 illustrates the parts that are employed in the fabrication of a glove made in accordance with the present invention. In this sense, FIG. 3 can be considered to be a "layout of parts." These of the pieces that are stitched together to form a glove made in accordance with the present invention.

Figure 4:
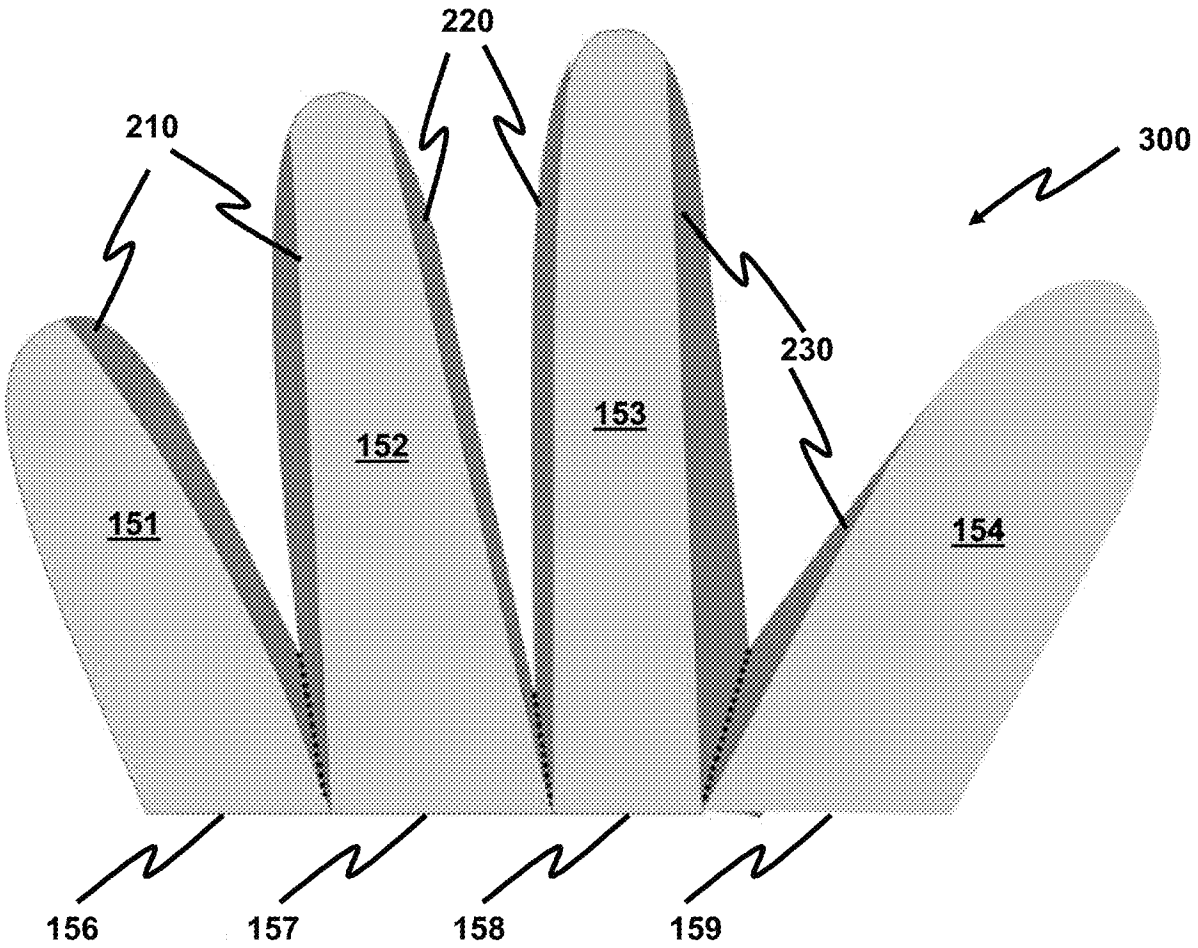
FIG. 4 is a top view illustrating the finger portion of a glove manufactured in accordance with the present invention and which particularly illustrates the formation of fourchette structures using finger material.

FIG. 4 illustrates a completed finger portion of glove 300 of the present invention. More particularly it is seen that a fourchette structure is illustrated as lying between pinky finger 151 and ring finger 152 (that is, reference numeral 210). It is also seen that similar structure 220 lies between ring finger 152 and middle finger 153. Similarly, structure 230 is produced between middle finger 153 and index finger 154. Also illustrated in FIG. 4 is the presence of tabs or slate extensions 156 through 159 lying along the bottom of the illustration. These correspond to the tab structures in FIG. 3 bearing the same reference numerals.

Figure 5:
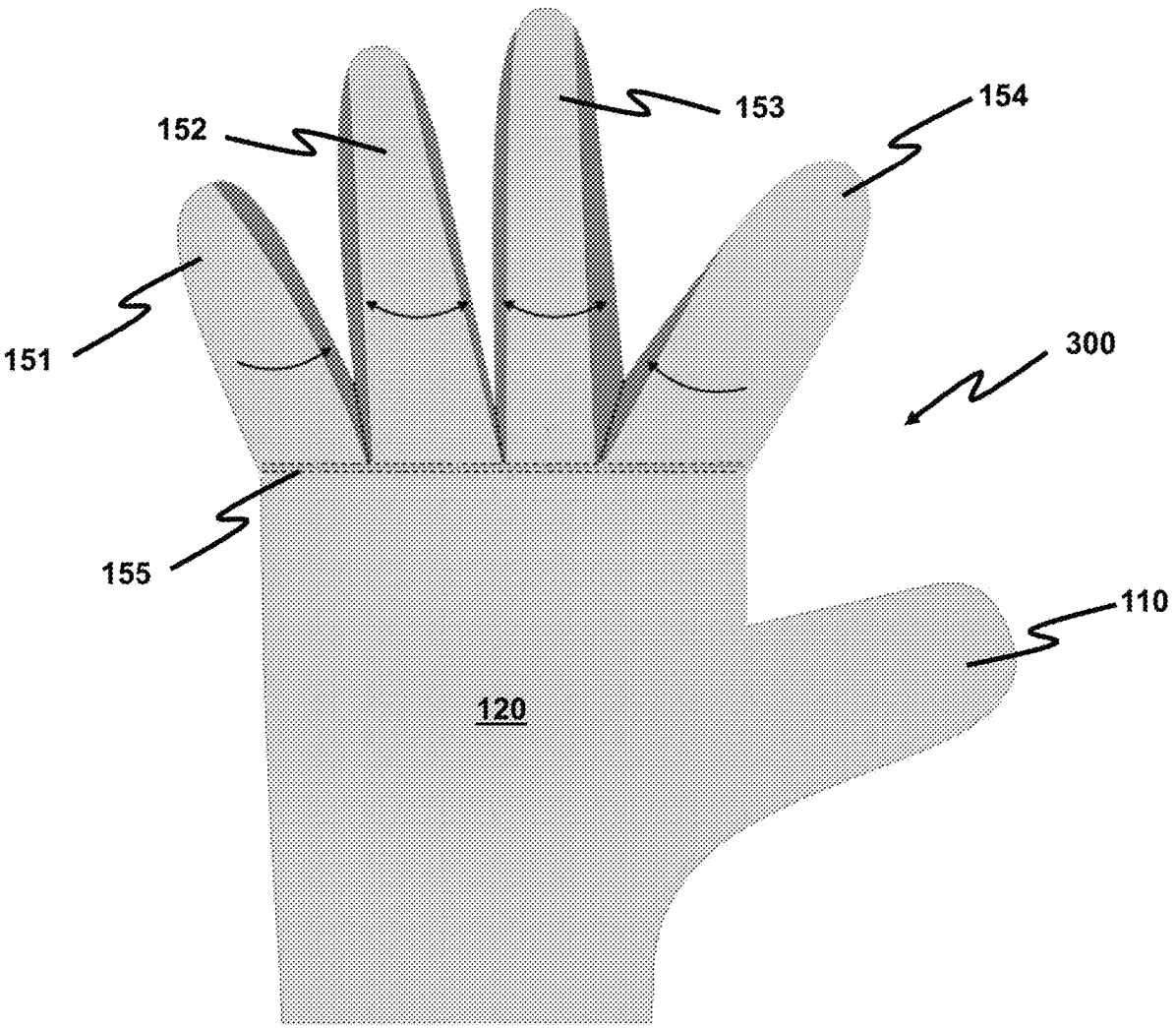
FIG. 5 is a top view illustrating a glove manufactured in accordance with the present invention and more particularly illustrating the single seam stitching of the finger portion to the palm portion.

FIG. 5 illustrates a glove completed in accordance with a first embodiment of the present invention. In particular, this figure illustrates the presence of stitched seam 155 which joins the finger portion to the palm portion. This stitching is shown as a dashed line from one side of the glove to the other. Also shown in FIG. 5 are arcs on the palm side of the finger portions. These arcs point to the effective fourchette structures produced in accordance with the present invention.

FIGS. 6, 7, 8 and 9 illustrate and alternate embodiment of the present invention in which one or more adjacent fingers are fabricated from a single piece of material that is from a material produced from a single stamping or cutting operation.

Figure 6:
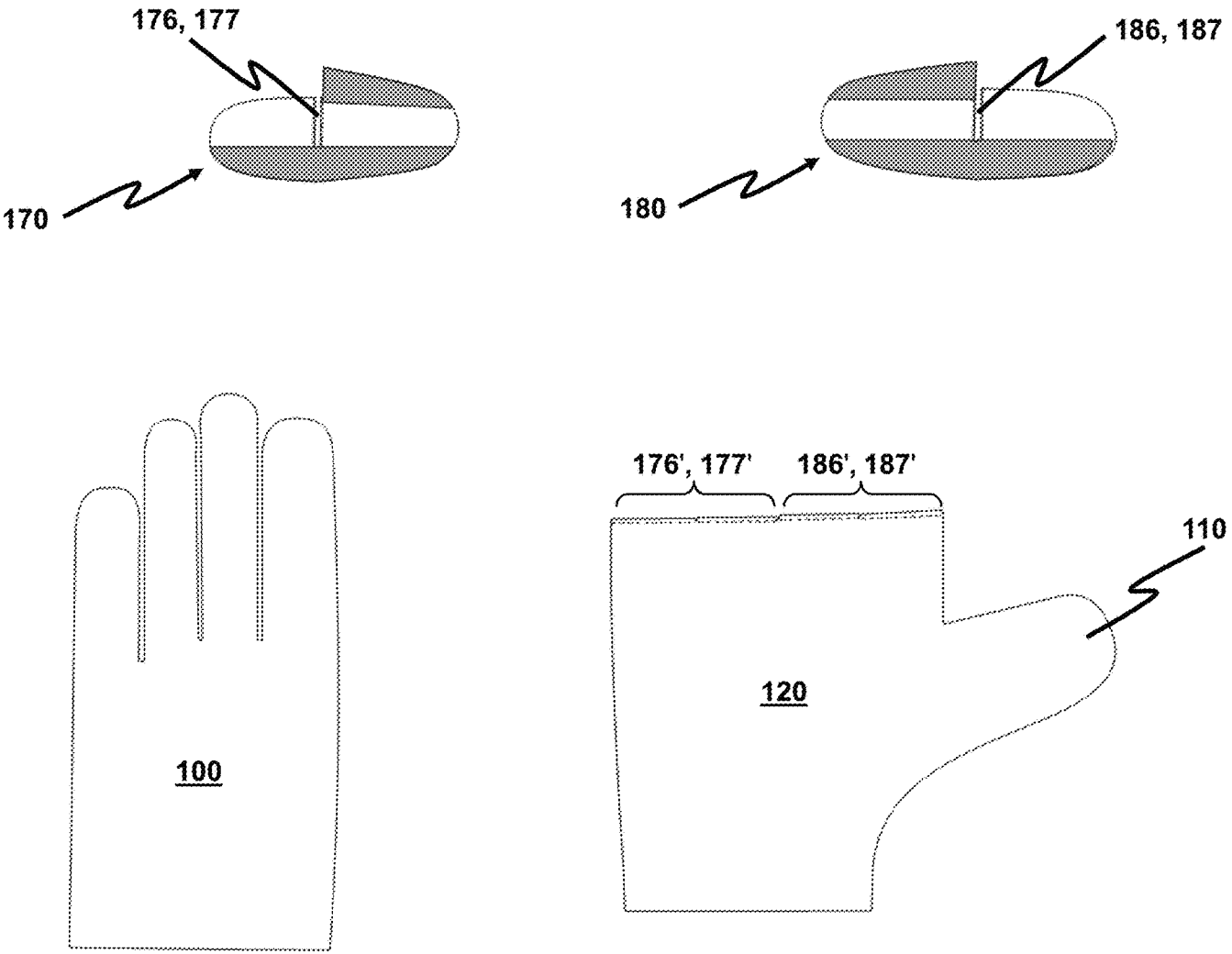
FIG. 6 is a top view illustrating the shape of finger stampings or cut outs employed in one embodiment of the present invention in which adjacent fingers are produced from the same piece of material.

In particular, it is noted that FIG. 6 illustrates that the pinky and ring finger are fabricated from a single piece of material 170. Similar to the tabs or extensions described above material 170 includes tabs or extensions 176 and 177 which are ultimately affixed to palm portion 120 at the locations described using corresponding reference numerals 176' and 177'. Likewise, it is noted that middle finger and index finger portions are constructed in this embodiment using a single piece of material 180. Likewise, as above, this piece of material also includes tab portions 186 and 187 (best seen in FIG. 6) which are ultimately stitched to palm portion 120 along seam 155 (best seen in FIG. 9).

As indicated above, while it would be possible to make ring finger 152 and middle finger 153 from a single piece of material, doing so would be significantly less desirable.

Figure 7:
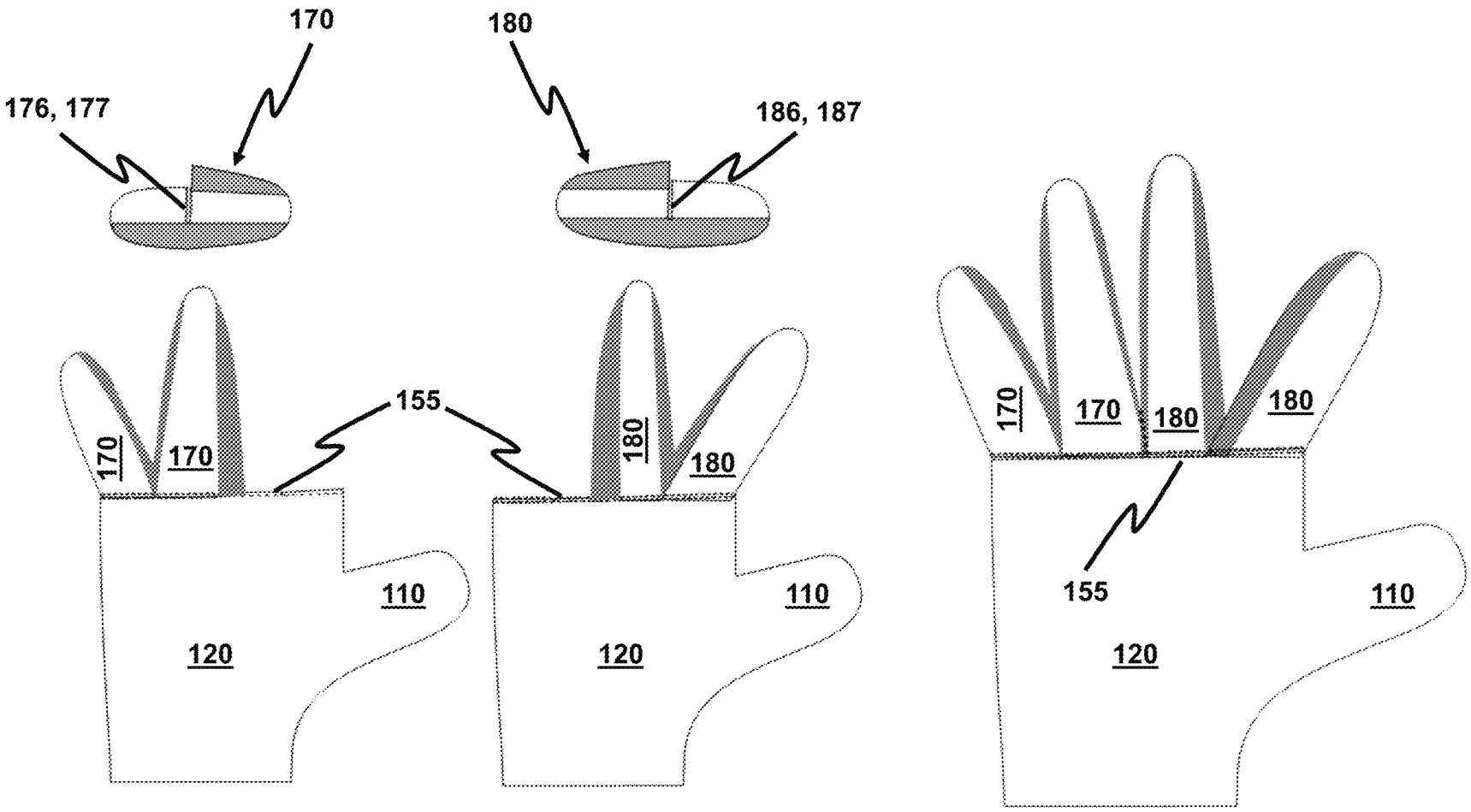
FIG. 7 is a top view illustrating a construction method for one embodiment of the present invention in which adjacent fingers are formed from an integral (or monolithic) piece of material.

FIG. 7 illustrates a sequence for assembling a glove in accordance with this second embodiment of the invention. Monolithic piece 170 is folded so as to align tabs 176 and 177 with palm portion 120. Stitching 155 may be employed at this time to attach pinky and ring fingers. In a similar fashion monolithic piece 180 representing finger portions for the middle and index finger are similarly folded so as to position tabs 186 and 187 along stitch line 155. Either 170 or 180 may be the first piece attached. In any event the resulting structure is shown in the rightmost portion of FIG. 7.

Figure 8:
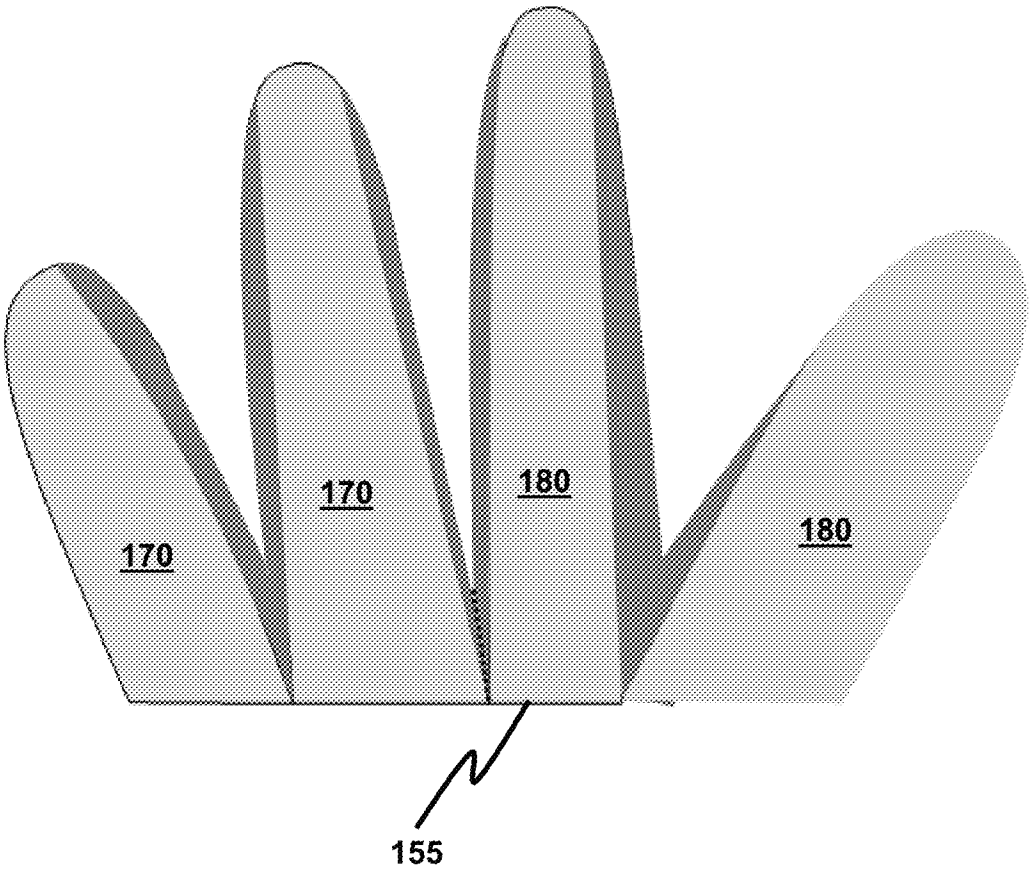
FIG. 8 is a top view illustrating the structure of the embodiment of the present invention in which adjacent fingers are formed from an integral (or monolithic) piece of material.
Figure 9:
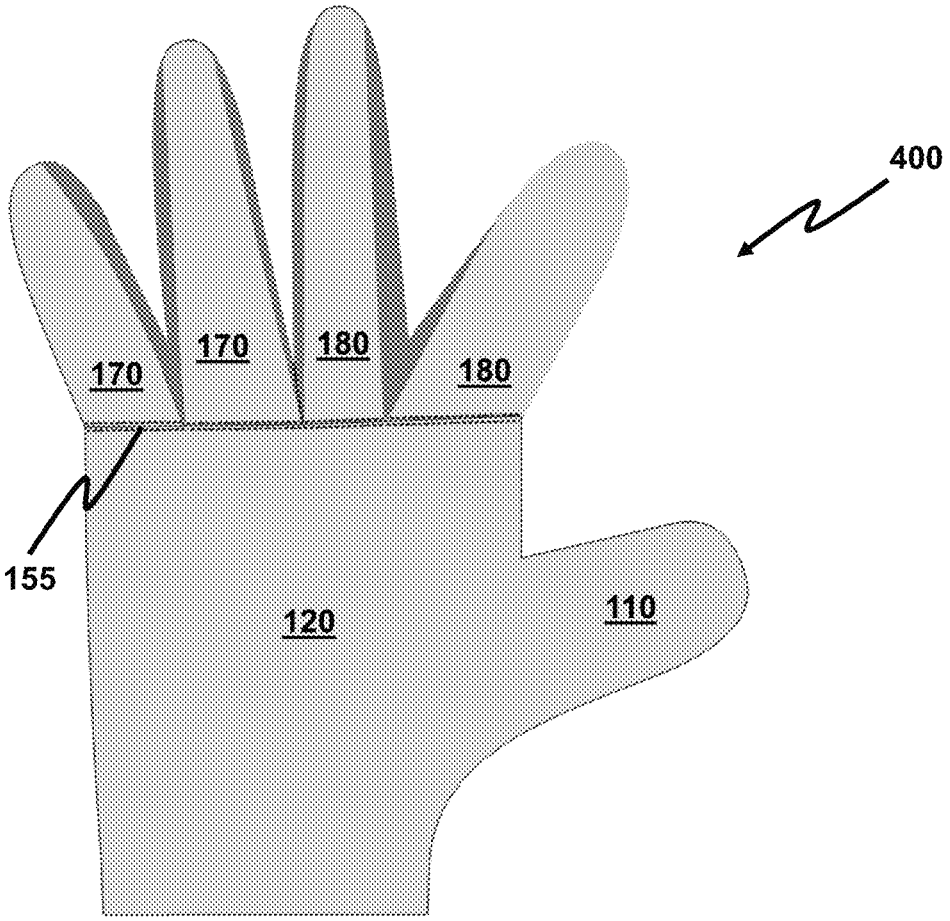
FIG. 9. It is a view similar to FIG. 5 but more particularly illustrating the monolithic construction of two pairs of adjacent fingers: the pinky and ring fingers and the middle and index fingers.

FIG. 8 illustrates the combination of monolithic finger portions 170 and 180. As above, shading is not necessarily employed to reflect the presence of different materials but rather to provide an indication of the resulting fourchette or at least fourchette-like structures. FIG. 9 is similar to FIG. 5 except that it illustrates a glove completed in accordance with a second embodiment of the present invention.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A glove having a plurality of fingers, said glove comprising:

a palm portion having attachment edges for attachment of individual finger portions to said palm portion, said palm portion also having a thumb opening;

a thumb portion affixed to said thumb opening in said palm portion at said thumb opening;

a back portion, having integral finger extensions, said back portion being sized to mate with said palm portion;

a plurality of individual finger portions having tab extensions for attachment to said palm portion along said attachment edge;

stitching which joins together said plurality of individual finger portions with said palm portion attachment edges; and stitching which joins together said finger extensions and said individual finger portions to form fingers for said glove, whereby the need to provide a separate fourchette structure is eliminated.

2. The glove of claim 1 in which there are a total of five fingers.

3. The glove of claim 1 in which said thumb portion, said palm portion, said back portion and said finger extensions individually comprise material selected from the group consisting of leather, fabric, cotton, elastomeric materials, wool, and suede.

4. A glove having a plurality of fingers, said glove comprising:

a palm portion having attachment edges for attachment of individual finger portions to said palm portion, said palm portion also having a thumb opening;

a thumb portion affixed to said thumb opening in said palm portion at said thumb opening;

a back portion, having integral finger extensions, said back portion being sized to mate with said palm portion;

a plurality of individual finger portions having tab extensions for attachment to said palm portion along said attachment edge, at least two of said individual finger portions comprise a unitary structure;

stitching which joins together said plurality of individual finger portions with said palm portion attachment edges; and stitching which joins together said finger extensions of said back portion and said individual finger portions to form fingers for said glove, whereby the need to provide a separate fourchette structure is eliminated.

5. The glove of claim 4 in which said thumb portion, said palm portion, said back portion and said finger portion individually comprise material selected from the group consisting of leather, fabric, cotton, elastomeric materials, wool, and suede.

6. The glove of claim 4 in which there are a total of five fingers.

7. The glove of claim 6 in which said fingers are designated as being a pinky finger, a ring finger, a middle finger, a index finger and a thumb and in which at least one of the following pairs comprises a unitary piece of material: said pinky and said ring finger; and said middle and said index finger.

* * * * *